US007654089B2

(12) United States Patent
Schilling et al.

(10) Patent No.: US 7,654,089 B2
(45) Date of Patent: Feb. 2, 2010

(54) GAS-TURBINE COMBUSTION CHAMBER WITH AIR-INTRODUCTION PORTS

(75) Inventors: Thomas Schilling, Mahlow (DE); Thomas Dörr, Berlin (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 09/843,168

(22) Filed: Apr. 27, 2001

(65) Prior Publication Data

US 2002/0017101 A1 Feb. 14, 2002

(30) Foreign Application Priority Data

Apr. 27, 2000 (DE) ..... 100 20 598

(51) Int. Cl.
*F01C 1/00* (2006.01)

(52) U.S. Cl. ..... 60/747; 60/752

(58) Field of Classification Search ..... 60/746, 60/752, 732, 747, 802
See application file for complete search history.

(56) References Cited

U.S. PATENT DOCUMENTS 4,246,758 A * 1/1981 Caruel et al. ..... 60/747
5,934,067 A * 8/1999 Ansart et al. ..... 60/804
6,058,710 A * 5/2000 Brehm ..... 60/747
6,474,070 B1 * 11/2002 Danis et al. ..... 60/739

FOREIGN PATENT DOCUMENTS

| | | |
|---|---|---|
| DE | 2838258 | 3/1979 |
| DE | 197 20402 | 11/1998 |
| EP | 0927854 | 7/1999 |
| EP | 0943868 | 9/1999 |
| JP | 05149543 | 6/1993 |
| WO | WO 96/27766 | 9/1996 |

* cited by examiner

*Primary Examiner*—Charles G Freay
(74) *Attorney, Agent, or Firm*—Timothy J. Klima

(57) ABSTRACT

This invention relates to a gas-turbine combustion chamber with at least one pilot burner (2) and at least one main burner (3) which are axially and radially offset relative to each other, said combustion chamber (1) comprising an outer flame-tube wall (4) and an inner flame-tube wall (5) each provided with ports for the introduction of air, and said main burner (3) being located at the outer flame-tube wall (4) and said pilot burner (2) being located at the inner flame-tube wall (5), characterized in that the outer flame-tube wall (4) is provided with a first arrangement (6) of ports and in that the inner flame-tube wall (5) is provided with a second arrangement (7) of ports.

16 Claims, 9 Drawing Sheets

GAS-TURBINE COMBUSTION CHAMBER WITH AIR-INTRODUCTION PORTS

Figure 1:
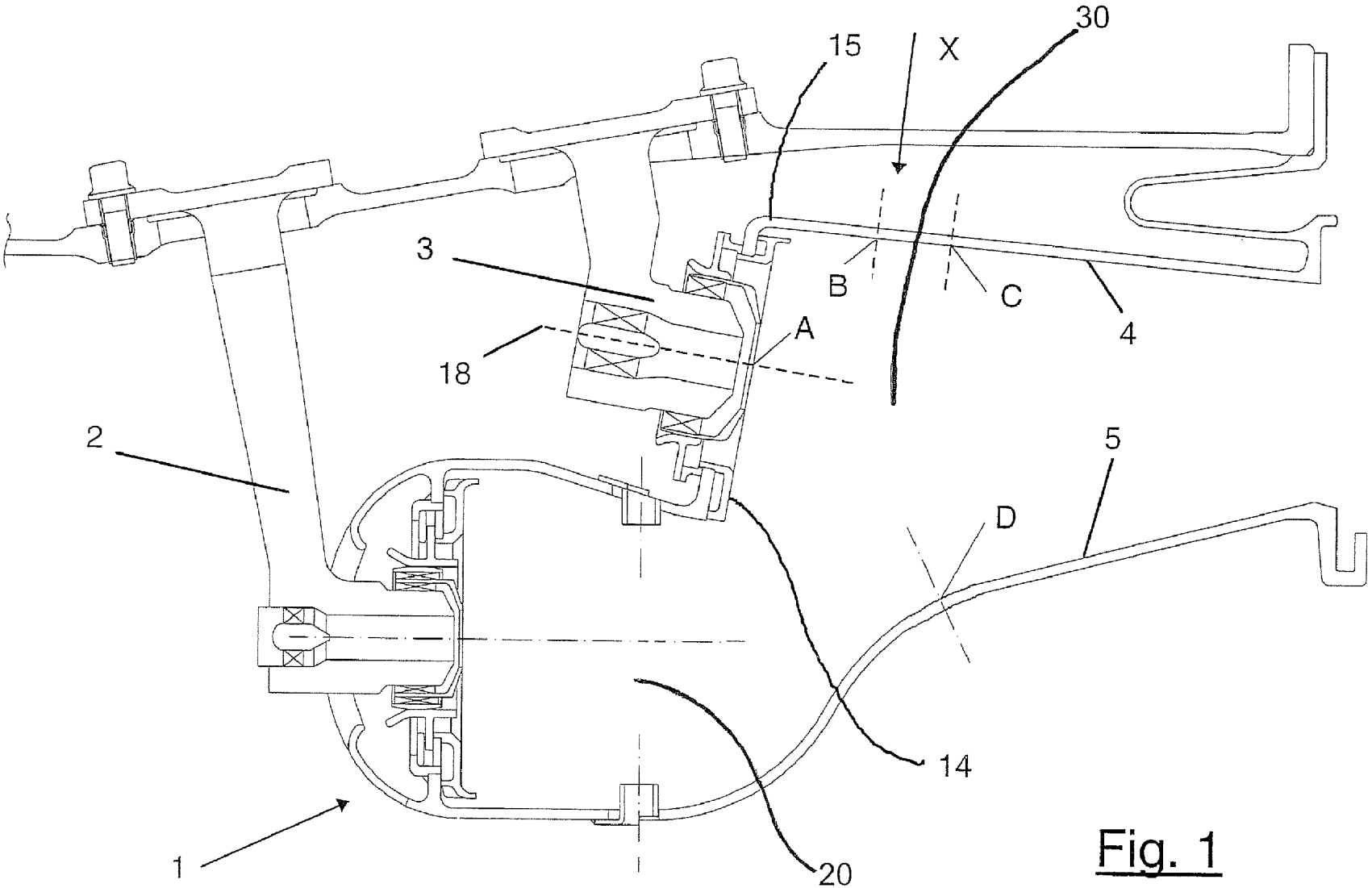

This invention relates to a gas-turbine combustion chamber with at least one pilot burner and at least one main burner which are axially and radially offset relative to each other, where the combustion chamber comprises an outer and an inner flame-tube wall each containing ports for the supply of air, said main burner being located at the outer flame-tube wall and said pilot burner being located at the inner flame-tube wall.

In the prior art, gas turbine combustion chambers are known which, for example, are designed as annular combustion chambers. To reduce the pollutant emission of gas turbine engines, dual-zone combustion chambers were developed, where one zone is designed for combustion at idle speed and part load and the other zone is designed for combustion in the upper load range. This design enables the corresponding development of pollutants to be influenced optimally.

The prior art, therefore, provides for combustion chambers with staged combustion in which a pilot stage and a main stage assume different functions. Each of these two stages can be optimised separately with regard to the pollutant-generation mechanisms specific to their respective operating conditions. In this context, the primary function of the main stage is to reduce the emission of the pollutants occurring during full-load operation, such as nitrogen oxides and soot, in comparison to the conventional combustion chambers.

Accordingly, combustion in the main stage is such that the air-fuel ratio initially provided by the main fuel vaporisers is characterised by an excess of fuel, relative to the stoichiometric ratio. By admixture of air, the mixture is transferred into a lean combustion state, characterised by an excess of air. This admixture or the dilution of the semi-burned gases with the dilution air, respectively, must be accomplished as intensively as possible to enable a homogeneously diluted state to be set as quickly as possible. A rapid mixing process (quenching) minimises the dwell time of the reaction gas within the range of stoichiometric combustion and counteracts the formation of thermal nitrogen oxide.

In the light of the above situation, the geometric design of the dilution air ports in the flame tube of the combustion chamber is crucial for the pollutant-reduction capability of a gas-turbine combustion chamber.

The design of the dilution air ports is further dependant upon the resultant temperature distribution at the combustion-chamber exit or the turbine inlet, respectively. Excessive temperatures involve the risk of damage to the high-pressure turbine.

The gas-turbine combustion chambers in accordance with prior art are designed for reduction of all relevant pollutants caused by combustion. Optimisation of the emission behaviour of the combustion chamber at high load points, which primarily results in a reduction of the nitrogen oxide emission, will, however, cause an increase in emissions such as carbon monoxide or unburned hydrocarbons at idle speed or part load.

Furthermore, combustion chambers with staged design are known in the prior art. Such combustion chambers, also termed dual-zone annular combustion chambers, feature an outer and an inner area. One of the areas is optimised for combustion at idle speed and part load, the other area is designed for the upper load range. For reduction of the nitrogen oxide emission, however, an optimised admixture port arrangement of the pilot stage and the main stage is required. The designs in accordance with prior art do not, or not adequately, provide remedy to said problems.

Prior art provides for arrangement of the pilot burner and the main burner on one plane or also circumferentially offset relative to each other.

Admixture port arrangements for combustion chambers of conventional design are disclosed in Patent Specifications EP 943 868 A2 and EP 927 854 A1.

Specification DE 197 20 402 A1 describes an axially staged annular combustion chamber of a gas turbine. It describes the allocation of a number of main burners to a number of pilot burners. In the combustion chamber walls, customary dilution-air ports are provided whose number and arrangement is not further explained.

Specification WO 96/27766 A1 shows a further development of an axially staged double-annular combustion chamber of a gas turbine. This Specification also provides for ports or holes, respectively, for dilution-air flows, the design and arrangement of these ports or holes not being further explained, as in the aforementioned Specification DE 197 20 402 A1. From Specification DE 28 38 258 A1, a combustion chamber arrangement is known which provides for at least one pilot burner and at least one main burner. Ports are provided in both the outer and the inner combustion chamber wall, these ports being designed as jets. Different to the present design, two combustion zones which are parallel to each other are provided which merge into a common zone relatively late. Accordingly, flow and combustion conditions exist which differ basically from the present invention.

In a broad aspect, the present invention provides a gas-turbine combustion chamber of the type described at the beginning which is optimised with regard to pollutant emission at different load ranges while being simply designed and manufactured cost-effectively.

In accordance with the present invention, the solution to the said problem is provided by the features cited in the main claim. Further advantageous embodiments will become apparent from the subclaims.

It is a particular object of the present invention to provide the outer flame-tube wall with a first arrangement of ports and the inner flame-tube wall with a second arrangement of ports.

The gas-turbine combustion chamber in accordance with the present invention is characterised by a number of advantages. The arrangement of the dilution air ports described will at all times provide for optimum combustion under the most different operating conditions, allowing a considerable reduction of the pollutant emission.

Accordingly, the arrangement of the ports in accordance with the present invention as regards their axial position, their size and the stagger of the individual arrangements or port rows as well as the allocation of the arrangements of dilution air ports of the inner and outer flame-tube walls provides for optimal combustion and reduction of the pollutant emission.

The present invention provides for the first arrangement of ports to be designed as single-row or as double-row, where, in the latter case, the ports of the second row can be located on centre or off-centre and rearwards to the interspaces of the ports of the first row. Both cases will result in an optimised supply of dilution air.

In a favourable development of the present invention, the second arrangement of ports in the inner flame-tube wall is designed as a single row, with the ports being placed on centre or off-centre in the interspace of the first row of ports of the first arrangement of the outer flame-tube wall.

Alternatively, the second arrangement of ports in the inner flame-tube wall can also be double-row, in which case, then, the ports of the first row are placed on centre or off-centre of the interspaces of the first row of ports of the first arrangement, and the ports of the second row are placed on centre or off-centre of the interspaces of the second row of ports of the first arrangement.

The combustion conditions will be particularly favourable if the following relationships are satisfied by the distance t1 of the centres of the ports of the first row and by the distance t2 of the centres of the ports of the second row of the first arrangement of ports in the outer flame-tube wall from an upstream wall of a flame tube of the main burner (main burner exit plain) to height h of the of flame tube:

$t1/h=0.4$ (minimum distance)

$t2/h=1.2$ (maximum distance).

In accordance with the present invention, the respective ports may be circular or non-circular.

In a further aspect of the present invention, the ports are provided either as plain holes or as plunged holes with a rim or with a tubular chute, said rim or chute extending into the combustion chamber.

In a preferred arrangement for the improvement of the combustion conditions, the exit axes of the ports of the inner flame-tube wall are directed such that they meet with an area of the combustion chamber which is limited by the intersection of the main burner axis with the main burner exit plane and by the intersection of the axis of the port arrangement with the outer flame-tube wall.

In a further advantageous development of the present invention, the diameter of the ports lies within a range of $0.12 \leqq d/h \leqq 0.3$, where h is the flame-tube height of the main burner and d is the diameter of a circular port or the hydraulic diameter of a non-circular port.

Figure 3:
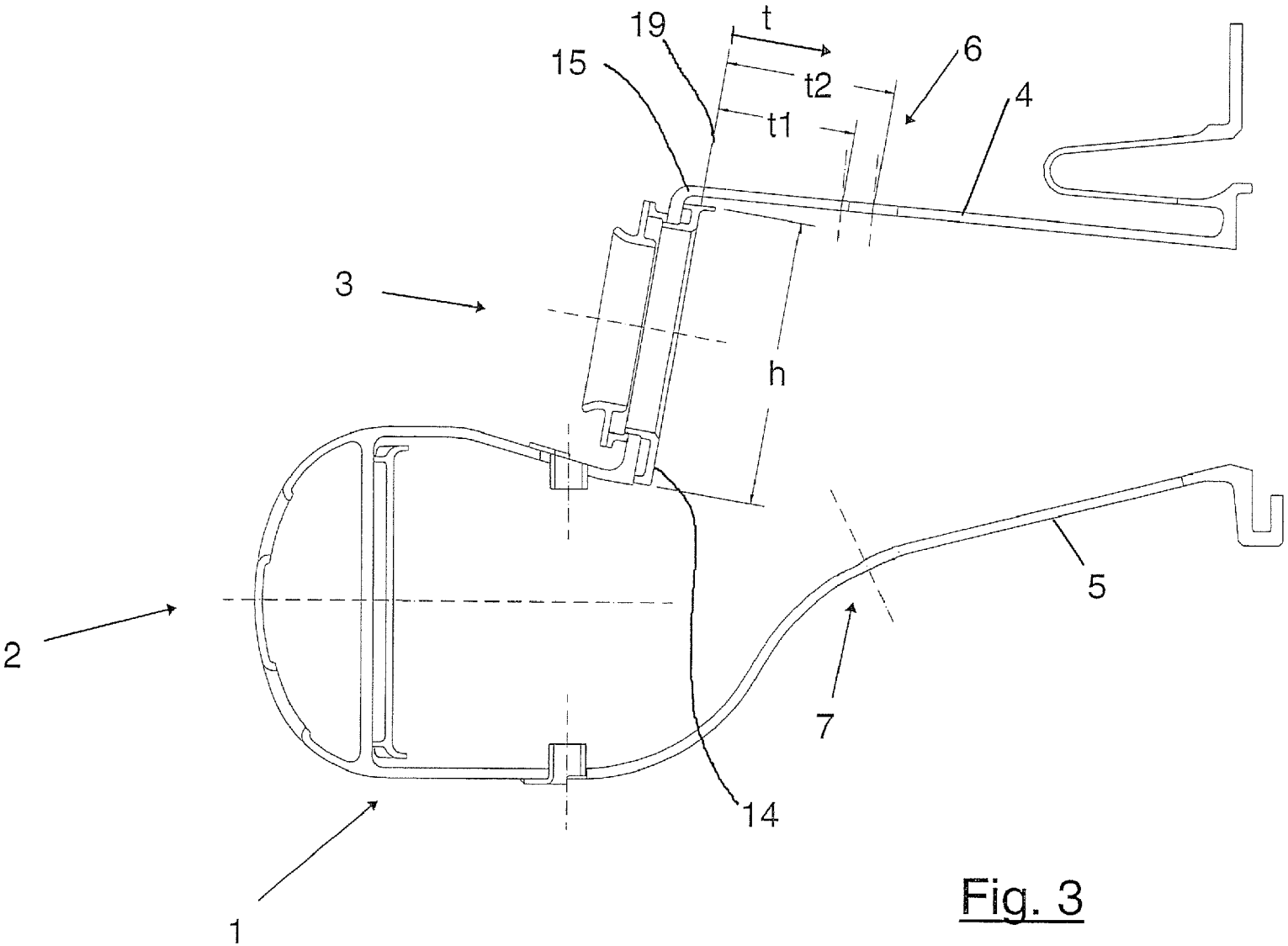
Figure 4:
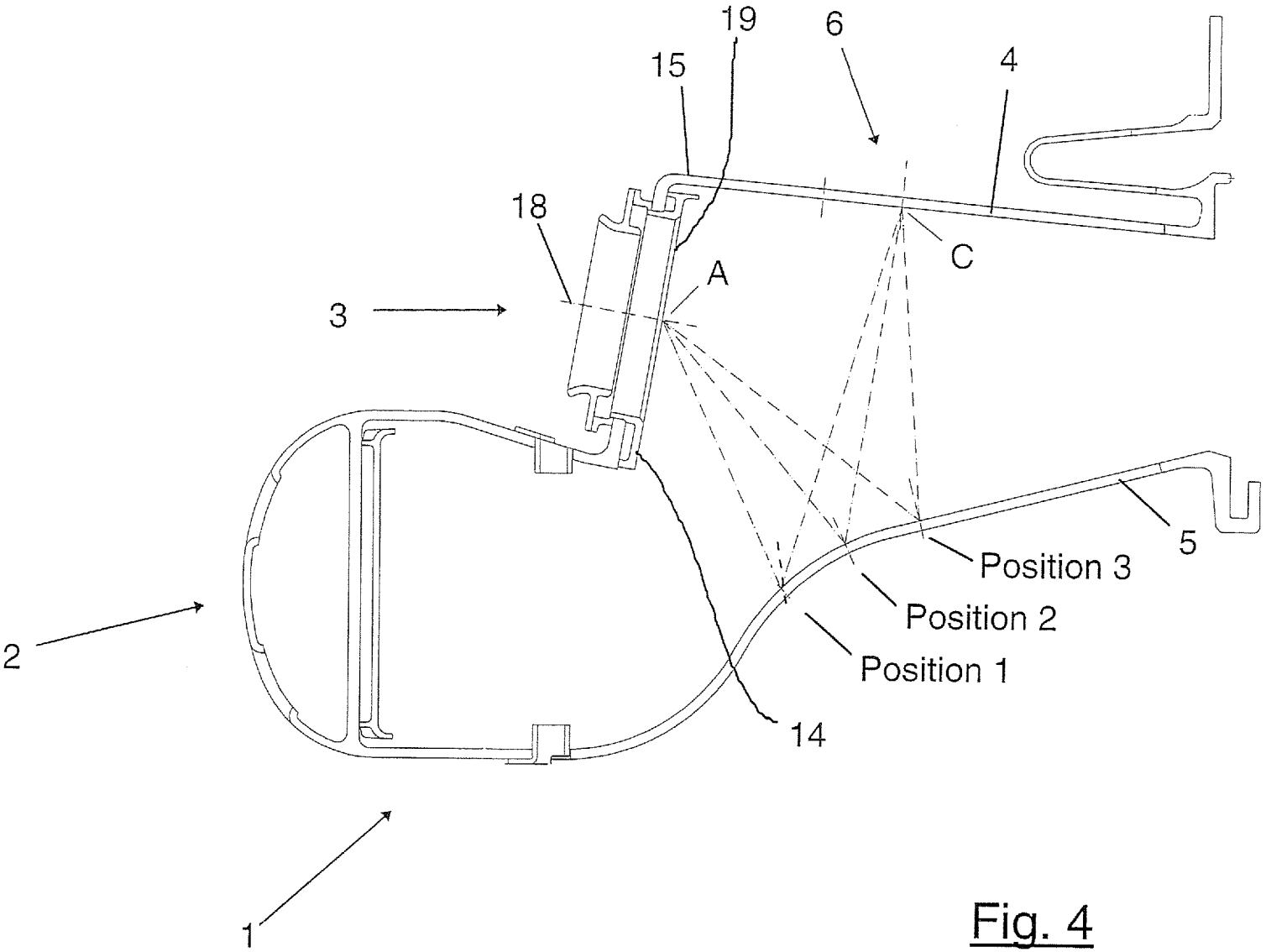
Figure 5:
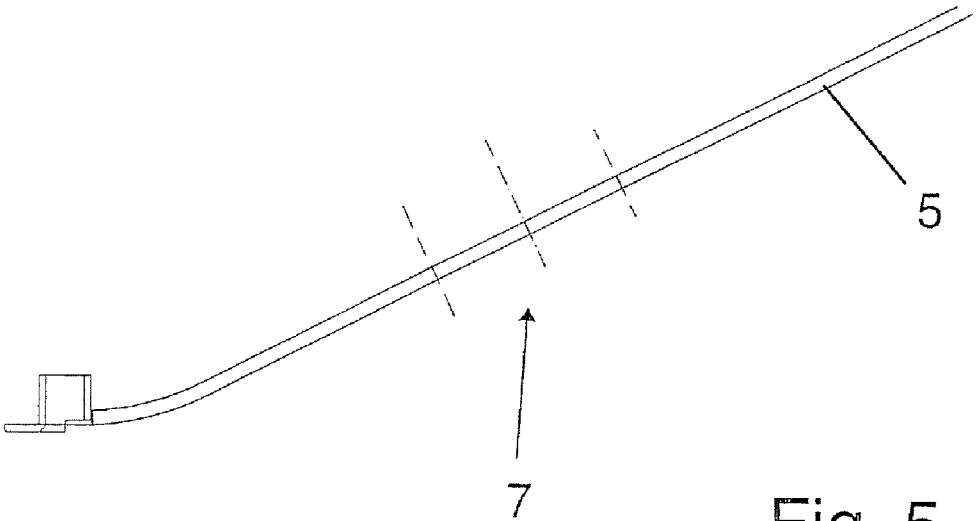
Figure 6:
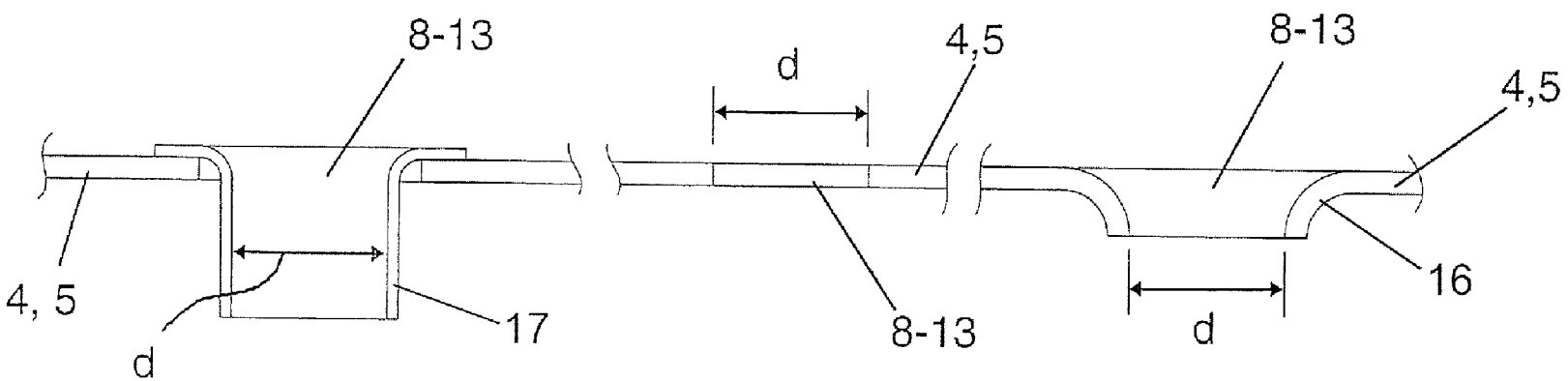

Further aspects and advantages of the present invention will become apparent in the light of the accompanying drawings. On the drawings, FIG. 1 is a simplified, schematic axial sectional view of the combustion chamber in accordance with the present invention, FIG. 2 is a view of an embodiment of the port arrangement on the outer flame-tube wall, FIG. 3 is a side sectional view analogously to FIG. 1 with dimensional indications for flame-tube height and the location of the ports of the outer flame-tube wall, FIG. 4 is a sectional view, similar to FIGS. 1 and 3, illustrating the positions of the ports of the inner flame-tube wall, FIG. 5 is a sectional view of an embodiment of the inner flame-tube wall showing a variation of the illustration of FIG. 4, FIG. 6 illustrates different embodiments of the ports in the flame-tube wall, FIG. 7 is a further embodiment of a port arrangement, analogously to the illustration of FIG. 2, FIG. 8 is an axial side view of a part area of the annular combustion chamber with illustration of the air exit flows, and FIG. 9 is an illustration of a further embodiment of the port arrangements, analogously to the illustration of FIGS. 2 and 7.

FIG. 1 shows an axial sectional view of an embodiment of the combustion chamber 1 in accordance with the present invention. It shows the staged arrangement of a pilot burner 2 which is used for idle speed, part load and also full load and of a main burner 3 which is used primarily for full-load operation. The combustion chamber 1 has an outer flame-tube wall 4 and an inner flame-tube wall 5 and is of the annular type, as becomes apparent from FIG. 8, for example. The centre axis of the several, circumferentially distributed main burners 3 is indicated by the reference numeral 18. Reference numeral 14 indicates the wall of a flame tube 15 of the main burner 3.

FIG. 1 illustrates a pilot zone 20 which is associated with or downstream of the pilot burner 2, while reference numeral 3 indicates a main or dilution zone 30 which is associated with the main burner.

Figure 2:
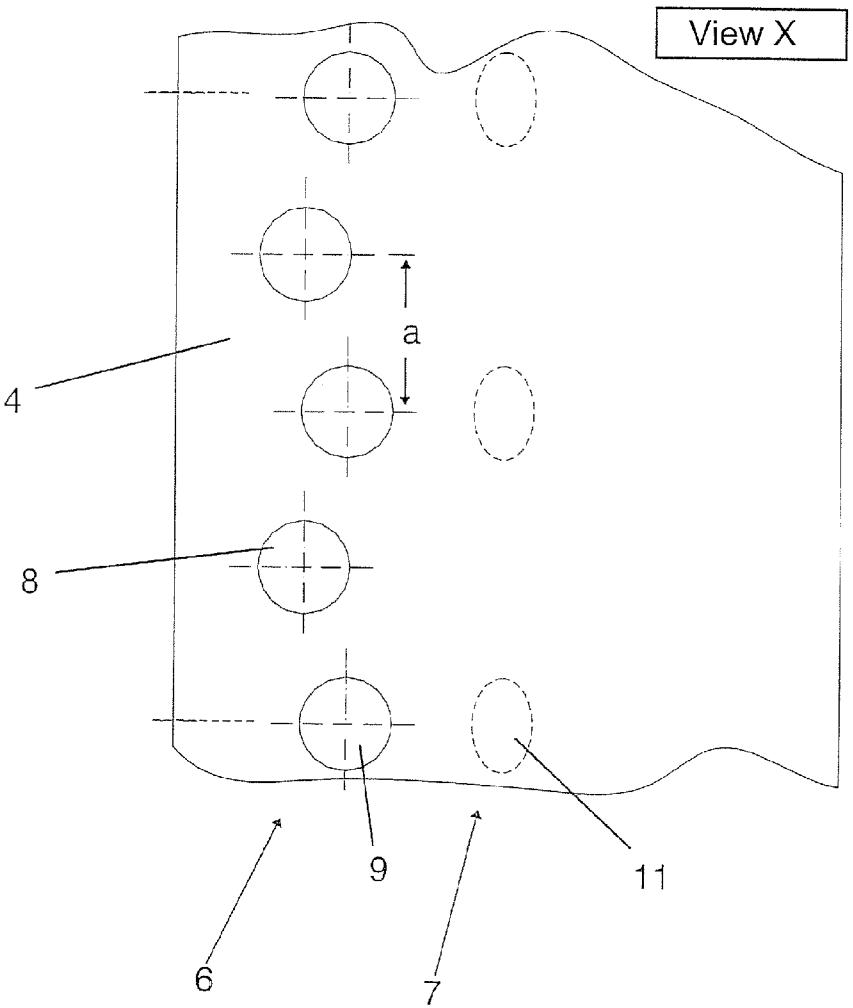
Figure 7:
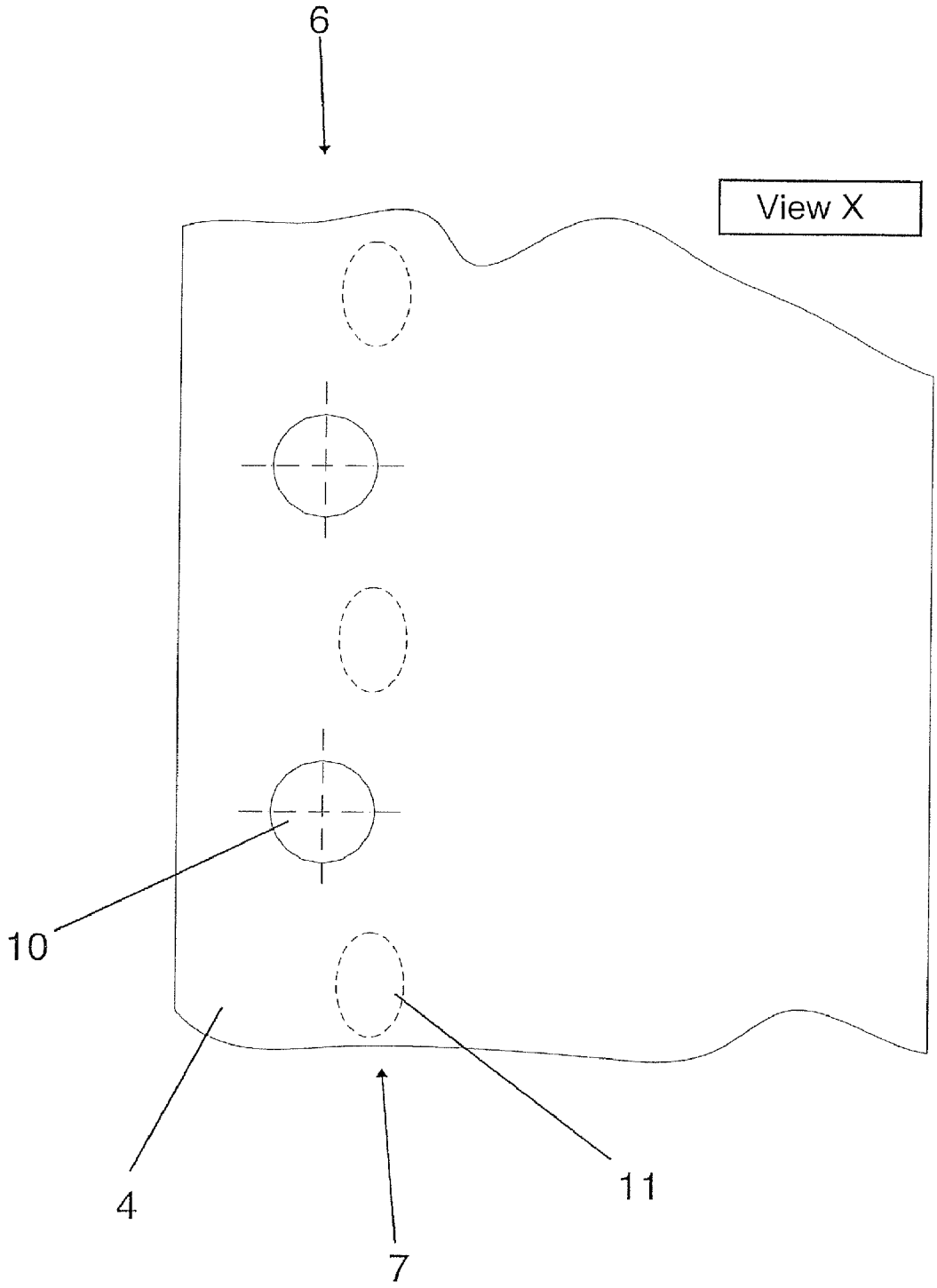
Figure 8:
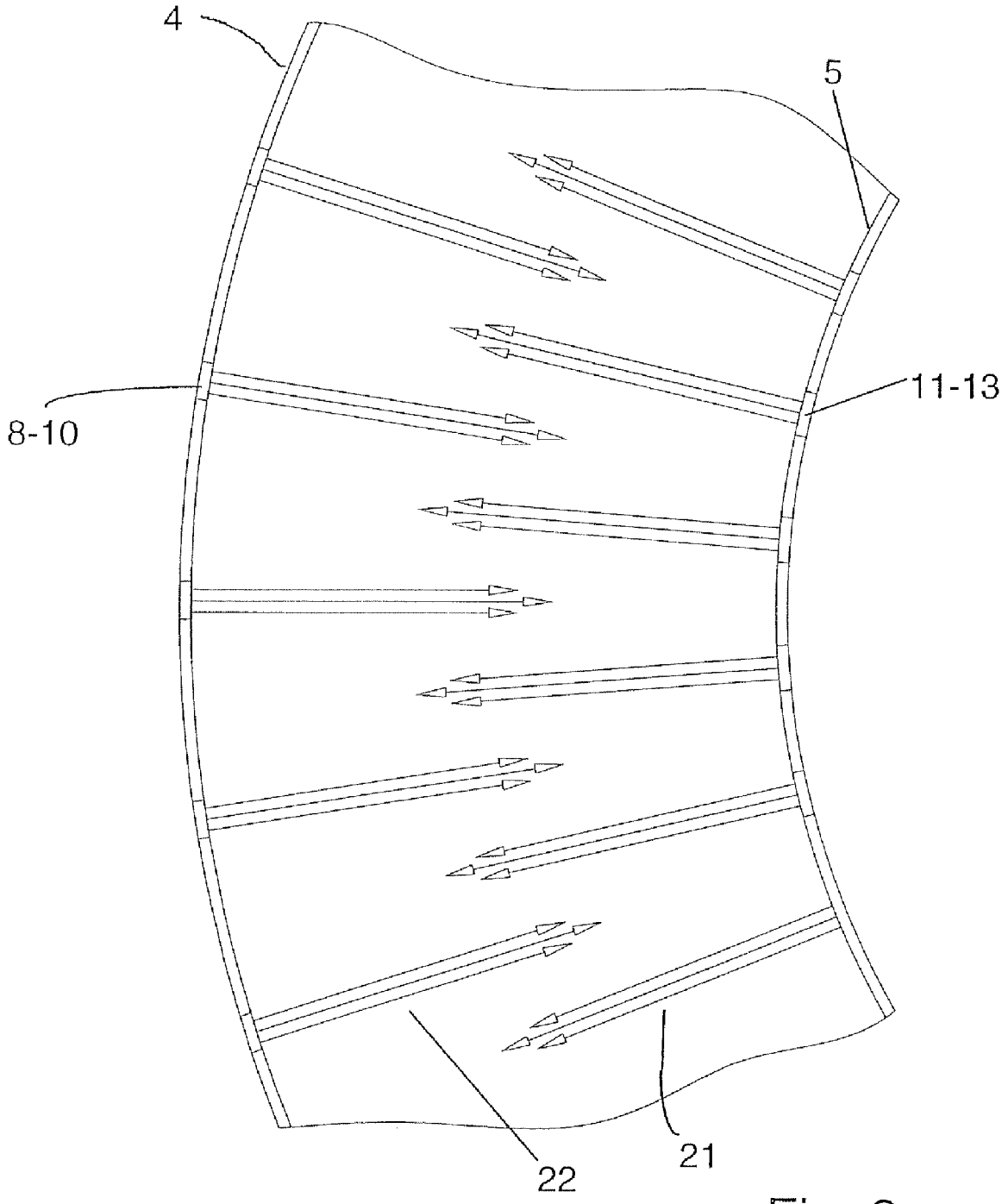
Figure 9:
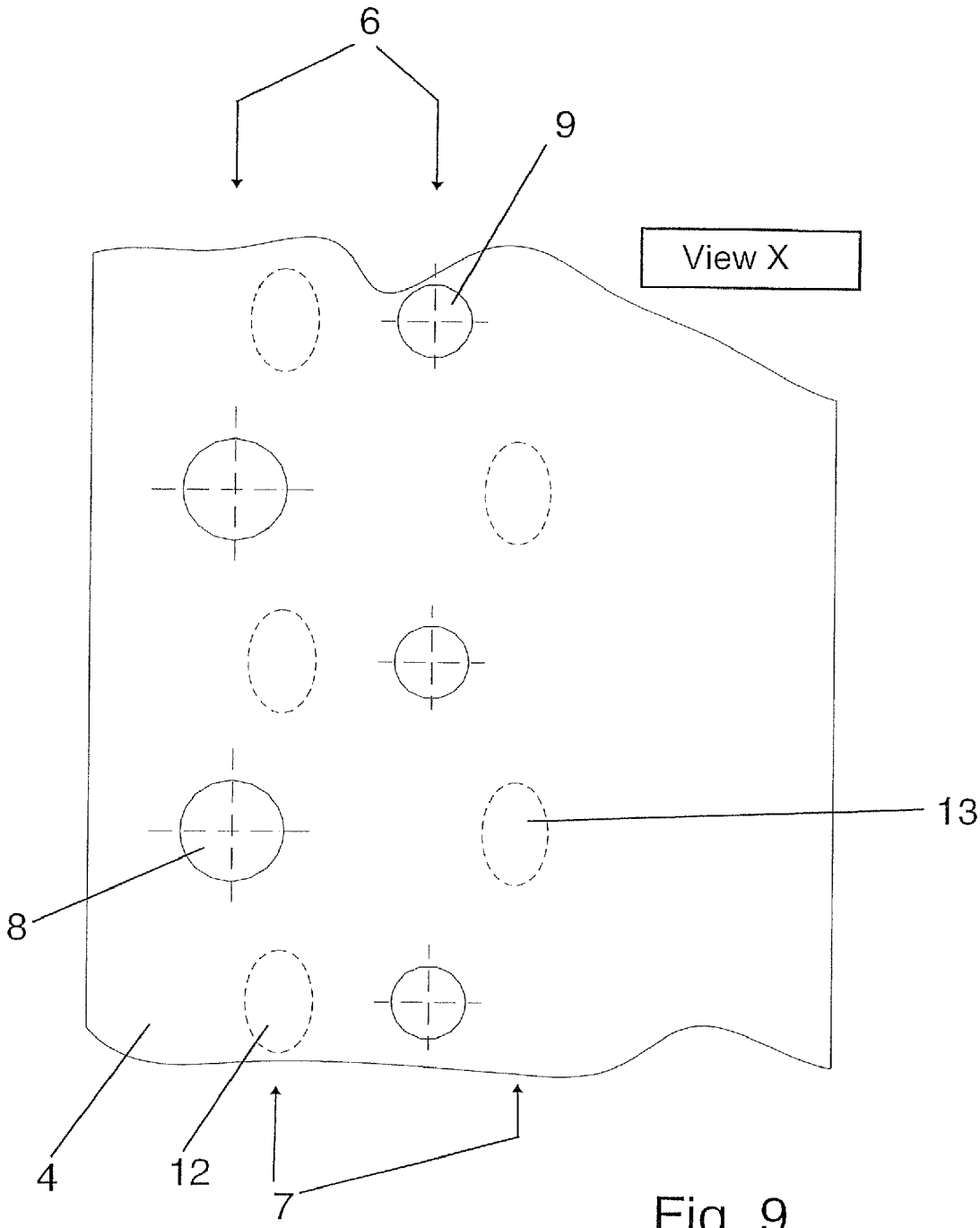

Letter X in FIG. 1 designates the direction of view on the port arrangement in FIG. 2, 7 and 9. For clarity purposes, the exit point of the axis 18 of the main burner 3 is designated in FIG. 1 with A, the penetration areas of the ports of the outer flame-tube wall 4 with B and C, and the penetration direction of the ports of the inner flame-tube wall 5 with D.

View X of FIG. 2 (direction of view X in accordance with FIG. 1) illustrates the arrangement of ports in the outer flame-tube wall 4 in a first embodiment. FIG. 2 shows a first arrangement 6 of ports in double-row design. The ports of the first row are designated with 8, the ports of the second row with 9. The ports are circular each. The ports 9 of the second row are placed on-center in the interspace between the ports 8. The ports 11 of the inner flame-tube wall 5 are shown as broken lines. In the projection, these ports appear oval or elliptic, but actually they are round. For clarity purposes, the ports 11 are illustrated "behind" the ports 8 and 9 in FIG. 2 and the following figures. However, these ports can also lie "below" the ports of the outer flame-tube wall 4. Accordingly, the outer flame-tube wall 4 contains a double-row arrangement of dilution ports. The diameters of the ports 8 in the first row and the diameters of the ports 9 in the second row of the first arrangement 6 may be equal or vary in either row. As regards their relationship, the two rows are offset by the distance a, i.e. the port axes, as viewed in downstream direction, do not align with or do not lie in a plane of a longitudinal section through the combustion chamber. The opposite port row at the inner flame-tube wall is a single row in the embodiment and designed such that the stagger of the port axes aligns with, or is in a plane with the main burner axis 18. It should be noted, however, that the term "align", in accordance with the present invention, does not provide for twice as much port axes as main burners (or common multiples). The diameter of the ports 11 of this second arrangement 7 in the inner flame-tube wall 5 may be equal or different. In the embodiment, the relationship of the ports on the inner flame-tube wall 5 and the outer flame-tube wall 4 has been selected such that the port axes either align with or are offset to the first row of ports 8 or the second row of ports 9 of the outer flame-tube wall 4.

FIG. 3 illustrates the position of the first arrangement 6 of the ports 8 or 9, respectively, on the outer flame-tube wall 4. As becomes apparent from the figure, the ports are located axially down the stream. Value t indicates the distance of the ports on the outer flame-tube wall 4 to the wall 14 of the flame tube 15 or to the main burner exit plane 19, respectively. Accordingly, distance t is the spacing between the axes of the openings. FIG. 3 furthermore shows the flame-tube height h, which is the height of the flame tube of the main combustion zone. The minimum distance of the first, upstream arrangement 6 of ports 8 (cf. FIG. 2) is at least t1/h=0.4; the maximum distance of the second, downstream row of ports 9 is no more than t2/h=1.2.

FIG. 4 illustrates various positions of the ports 11 to 13 of the first and the second row of second arrangements 7 on the inner flame-tube wall 5. As alternative, FIG. 5 provides a modified design of the inner flame-tube wall 5 with analogous illustration of the "positions". The exit axes of the ports 11, 12 and 13 of the inner flame-tube wall 5 are set such that they meet an area of the combustion chamber which is confined by the intersection A of the main burner axis 18 with the main burner exit plane 19 and the intersection C of the axis of the arrangement 6 of ports 8 to 10 on the outer flame-tube wall 4. The maximum upstream orientation is, therefore, confined by a centre axis of the ports 11 to 13 directed to the inlet plane of the main burner axis 18 (Point A). The maximum downstream orientation of the ports 11 to 13 on the inner flame-tube wall 5 is confined by a centre axis directed to the exit plane of the second, downstream row of ports 8 to 10 of the outer flame-tube wall 4 (Point C). FIG. 4 shows examples of three "positions" of the ports 11 to 13 of the inner flame-tube wall 5. Apparently, the inner flame-tube wall 5 may have different contours (cf. FIG. 4 and 5 for differences) and additional "positions" of ports in the area indicated. Accordingly, the "positions" indicated for the ports 11 to 13 are all in the main zone of the main burner 3, while the exit directions of the ports do not extend into the pilot zone area of the pilot burner 2.

FIG. 6 illustrates different embodiments of the ports 8 to 13. In the left-hand embodiment, the port is provided with a tubular chute 17 which extends into the combustion chamber. In the embodiment in the middle of FIG. 6, a plain circular hole is shown. Furthermore, the right-hand embodiment of FIG. 6 illustrates a plunged port whose rim 16 extends into the combustion chamber. Apparently, the ports may be circular or non-circular. The size of the ports is limited for all ports described herein to lie within the range of $0.12<d/h<0.3$, where d is the diameter of a circular port or the hydraulic diameter of a non-circular port and where h is the flame-tube height of the main burner (cf. FIG. 3).

FIG. 7 illustrates a further embodiment in which the outer flame-tube wall contains only one row of ports 10 while the inner flame-tube wall contains a second, single-row arrangement of ports 11. The ports are circular, but appear as elliptic broken lines in the FIG. 7, which is due to the direction of "View X". Accordingly, a single-row arrangement of dilution ports is provided in the outer flame-tube wall 4, in which the diameter of the ports 10 within the row can either be equal or different. The second arrangement 7 of ports 11 on the inner flame-tube wall 5 is single-row and located such that their axes are each offset and staggered to the axes of the ports 10 of the outer flame-tube wall 4. This means that the axes of the ports 11 of the inner flame-tube wall 5 and the axes of the ports 10 of the outer flame-tube wall 4 "mesh" with each other. The diameters of the ports 11 of the inner flame-tube wall 5 can be equal or different. In this embodiment, it is irrelevant whether or not all or certain axes of the ports 11 on the inner flame-tube wall 5 or of the ports 10 of the outer flame-tube wall 4 lie in planes of the main burners 3.

FIG. 8 illustrates an axial partial sectional view of the combustion chamber in accordance with the present invention. For clarification, the direction of the air flows which enter through the outer flame-tube wall 4 or through the inner flame-tube wall 5, respectively, are indicated by triple arrows, with the reference numeral 22 showing the air flows through the outer flame-tube wall and the reference numeral 21 showing the air flows from the inner flame-tube wall 5. As can be seen from the illustration, the individual dilution air flows are in mesh with each other.

FIG. 9 illustrates a further embodiment of the arrangement of ports. This arrangement is analogous to the illustration of FIG. 7, but with the first arrangement 6 of ports on the outer flame-tube wall 4 and the second arrangement 7 of ports on the inner flame-tube wall 5 being both designed as double rows. In this illustration, the ports 13 of the second row and the ports 12 of the first row of the second arrangement 7 of ports on the inner flame-tube wall 5 are shown as ellipses, which is again due to the direction of view "X". As can be seen, the rows of ports face each other and mesh with each other.

It is apparent that a plurality of modifications other than those described herein may be made to the embodiments of this inventions without departing from inventive concept.

In summary, this invention relates to a gas-turbine combustion chamber with at least one pilot burner 2 and at least one main burner 3 which are axially and radially offset to each other, with the combustion chamber 1 comprising an outer flame-tube wall 4 and an inner flame-tube wall 5 each containing ports for the introduction of air, said main burner 3 being located at the outer flame-tube wall 4 and said pilot burner 2 being located at the inner flame-tube wall 5, characterised in that the outer flame-tube wall 4 contains a first arrangement 6 of ports and in that the inner flame-tube wall 5 contains a second arrangement 7 of ports located downstream of the first arrangement 6 of ports (FIG. 1).

| List of references |
|---|
| 1. Combustion chamber |
| 2. Pilot burner |
| 3. Main burner |
| 4. Outer flame-tube wall |
| 5. Inner flame-tube wall |
| 6. First arrangement of ports on the outer flame-tube wall 4 |
| 7. Second arrangement of ports on the inner flame-tube wall 5 |
| 8. Ports of the first row of the first arrangement 6 |
| 9. Ports of the second row of the first arrangement 6 |
| 10. Ports of the first arrangement 6 |
| 11. Ports of the second arrangement 7 |
| 12. Ports of the first row of the second arrangement 7 |
| 13. Ports of the second row of the second arrangement 7 |
| 14. Wall of the flame tube 15 of the main burner 3 |
| 15. Flame tube of the main burner 3 |
| 16. Rim |
| 17. Tubular chute |
| 18. Axis of main burner 3 |
| 19. Main burner exit plane |
| 20. Pilot zone |
| 21. Air flow from the inside |
| 22. Air flow from the outside |
| 30. Main and dilution zone |
| A Intersection of the main burner axis with wall 14 |
| B Intersection of the port axis of the first row of the first arrangement 8 with the inner side of the outer wall of the flame tube 15 |
| C Intersection of the port axis of the second row of the first arrangement 9 with the inner side of the outer wall of the flame tube 15 |
| D Intersection of the port axis of the first row of the second arrangement 7 with the inner side of the inner wall of flame tube 15 |
| X View on the outer side of the outer flame tube wall |

What is claimed is:

1. An axially staged annular gas-turbine combustion chamber comprising:

a plurality of pilot burners arranged in an annular configuration;

at least one pilot zone positioned adjacent the pilot burners;

a plurality of main burners arranged in an annular configuration;

at least one common main zone positioned adjacent the main burners, the pilot burners and the main burners being axially and radially offset relative to each other with exit portions of the main burners located downstream of exit portions of the pilot burners, said common main zone located downstream of the pilot zone and comprising:

an outer flame-tube wall, and an inner flame-tube wall, each wall provided with ports for the introduction of air into the common main zone, with said main burners being radially positioned toward the outer flame-tube wall and with said pilot burners being radially positioned toward the inner flame-tube wall, wherein the outer-flame tube wall ports include a first arrangement of ports including a single first row of ports and the inner flame-tube wall ports include a second arrangement of ports including a single first row of ports, with the ports of the second arrangement being circumferentially aligned off-center with the ports of the first row of the first arrangement, wherein the first arrangement of ports includes a second row of ports, with the ports of the second row being aligned circumferentially off-center with, and positioned rearwards of the ports of the first row of the first arrangement.

2. A gas-turbine combustion chamber in accordance with claim 1, wherein the second arrangement of ports on the inner flame-tube wall includes a second row of ports, with the ports of the second row of the second arrangement being aligned circumferentially on-center with the ports of the first row of the first arrangement.

3. A gas-turbine combustion chamber in accordance with claim 1, wherein the following relationships are satisfied by a distance t1 from centers of the ports of the first row of the first arrangement to an upstream wall of a flame tube of one of the main burners, a distance t2 from centers of the ports of the second row of the first arrangement to the upstream wall of the flame tube of the one of the main burners, and a height h of the flame tube of the one of the main burners:

$$t1/h \geqq 0.4,$$

$$t2/h \approx 1.2.$$

4. A gas-turbine combustion chamber in accordance with claim 1, wherein the ports are circular.

5. A gas-turbine combustion chamber in accordance with claim 1, wherein the ports are non-circular.

6. A gas-turbine combustion chamber in accordance with claim 1, wherein the ports are plain boles in the flame-tube walls.

7. A gas-turbine combustion chamber in accordance with claim 1, wherein the ports are plunged holes in the flame-tube walls having small rims extending into the combustion chamber.

8. A gas-turbine combustion chamber in accordance with claim 1, wherein the ports include tubular chutes extending into the combustion chamber.

9. A gas-turbine combustion chamber in accordance with claim 1, wherein exit axes of the ports of the second arrangement are respectively aligned to lie within an angle formed between a first line extending from the respective exit axes of the ports to an intersection (A) of a main burner axis with a main burner exit plane and a second line extending from the respective axes of the ports to an intersection (C) of an axis of downstream-most ports of the first arrangement with the outer flame-tube wall.

10. A gas-turbine combustion chamber in accordance with claim 1, wherein a diameter d of the ports is set so that d/h lies in a range of $0.12 \leqq d/h \leqq 0.3$, where h is a flame-tube height of the main burners.

11. A gas-turbine combustion chamber in accordance with claim 1, wherein the ports of the first row of the second arrangement are aligned circumferentially on-center with the ports of the second row of the first arrangement.

12. A gas-turbine combustion chamber in accordance with claim 11, wherein the second arrangement of ports on the inner flame-tube wall includes a second row of ports, with the ports of the second row of the second arrangement being aligned circumferentially on-center with the ports of the first row of the first arrangement.

13. A gas-turbine combustion chamber in accordance with claim 12, wherein the ports of the second row of the second arrangement are rearward of the ports of the first row of the second arrangement.

14. A gas-turbine combustion chamber in accordance with claim 11, wherein the ports of the second row of the first arrangement are rearward of the ports of the first row of the second arrangement.

15. A gas-turbine combustion chamber in accordance with claim 1, wherein the ports of the first arrangement are greater in number than the ports of the second arrangement.

16. A gas-turbine combustion chamber in accordance with claim 15, wherein the ports of the first arrangement are double in number than the ports of the second arrangement.

* * * * *